US005768864A

United States Patent [19]

Chang

[11] Patent Number: 5,768,864

[45] Date of Patent: Jun. 23, 1998

[54] SADDLE GIRTH WITH PROTECTIVE COVER

[76] Inventor: Robert Chang, Merryearn, Ltd. 301-2 Fa Yuen Commercial Bldg. 75-77 Fa Yuen St., Mongkok, Kowloon, Hong Kong, China

[21] Appl. No.: 644,312

[22] Filed: May 10, 1996

[51] Int. Cl.[6] ..... B68C 1/14

[52] U.S. Cl. ..... 54/23

[58] Field of Search ..... 54/4, 23, 35, 46.1

[56] References Cited

U.S. PATENT DOCUMENTS 3,805,491 4/1974 Deal ..... 54/23

3,828,521 8/1974 Dulaney ..... 54/23

5,426,924 6/1995 Harty ..... 54/23

*Primary Examiner*—Robert P. Swiatek

*Attorney, Agent, or Firm*—Jerry C. Ray

[57] ABSTRACT

A protective cover for saddle girths is made of a thickness of scratch-resistant and tear-resistant polyvinyl chloride having a textured surface. The cover is in the form of a sleeve covering the belt portion of the girth to act as a protective pad between the girth and the horse's skin, and is of a closed-cell foam to prevent absorption of water. Toughness of the cover prevents tears and abrasions by spurs, brush, and the like, increasing the longevity of the cover and enhancing its appearance.

4 Claims, 2 Drawing Sheets

SADDLE GIRTH WITH PROTECTIVE COVER

BACKGROUND OF THE INVENTION

1. Field of the Invention

This invention relates to protective covers for girths or surcingles on equestrian saddles, and especially to such girths having covers which are resistant to tearing and abrasion.

2. Description of the Related Art

Equestrian saddles are held in place on a horse's back by a girth, also called a surcingle, which attaches to either side of the saddle and extends under and around the horse's belly. Girths for English-style saddles have two buckles on each end; Western-style saddles have one buckle on each end. In both types of saddles, the girth buckles attach to straps extending from under the flap on each side of the saddle.

Girths may be made of a leather band, a flat band of several strong cords strung between the buckles, or a belt of woven material. But a girth can rub and gall a horse's skin, causing irritation and rawness; the pain of the chafing may make a horse try to buck off saddle and rider alike. Of course, a horse injured by raw or chafed skin is unridable until the affected area heals.

Various types of girths with protective covers have been devised to protect a horse's skin from chafing by the belt of the girths. The problem is that soft materials are quickly torn and abraded by spurs, brush, thorns, etc., becoming unsightly and ineffective. The problem addressed by the present invention is how to provide a suitably soft and protective cover for a girth that will also resist tearing and abrasion by spurs, brush, thorns, etc. An earlier effort to solve this problem is disclosed in a patent by Harty (5,426,924), which has a separate layer of protective material attached to a tearable cover. The function of the outer layer is to protect the cover against tearing.

SUMMARY OF THE INVENTION

This invention provides a saddle girth with a cover having a textured surface; the cover is resistant to tearing by spurs, thorns, and the like. Resistance to tearing, scratching, and abrasion is accomplished by making the cover from expanded polyvinyl chloride, a material more generally used in the manufacture of insulation, film, and pipe. A sleeve of expanded polyvinyl chloride forms the cover; the sleeve receives the length of a saddle girth to form a protective pad between the girth and the horse's skin. Sewing or other means of attachment is used to make the cover integral with the girth.

Based on the above, it is an object of this invention to provide a cover for saddle girths which is resistant to tearing, scratching, and abrasion.

A further object is to provide a saddle girth with a cover which is soft and protective, reducing friction between the girth and a horse's skin, protecting the horse from injury.

Another object is to provide a girth having a protective cover which is resistant to weathering and discoloration from sweat, soap, and other materials, and which retains its appearance despite heavy use.

Further objects are to achieve the above with a device that is sturdy, durable, lightweight, safe, and reliable, yet inexpensive and easy to manufacture, install, and maintain.

The specific nature of the invention, as well as other objects, uses, and advantages thereof, will clearly appear from the following description and from the accompanying drawings, the different views of which are not necessarily scale drawings.

CATALOG OF THE ELEMENTS

Figure 1:
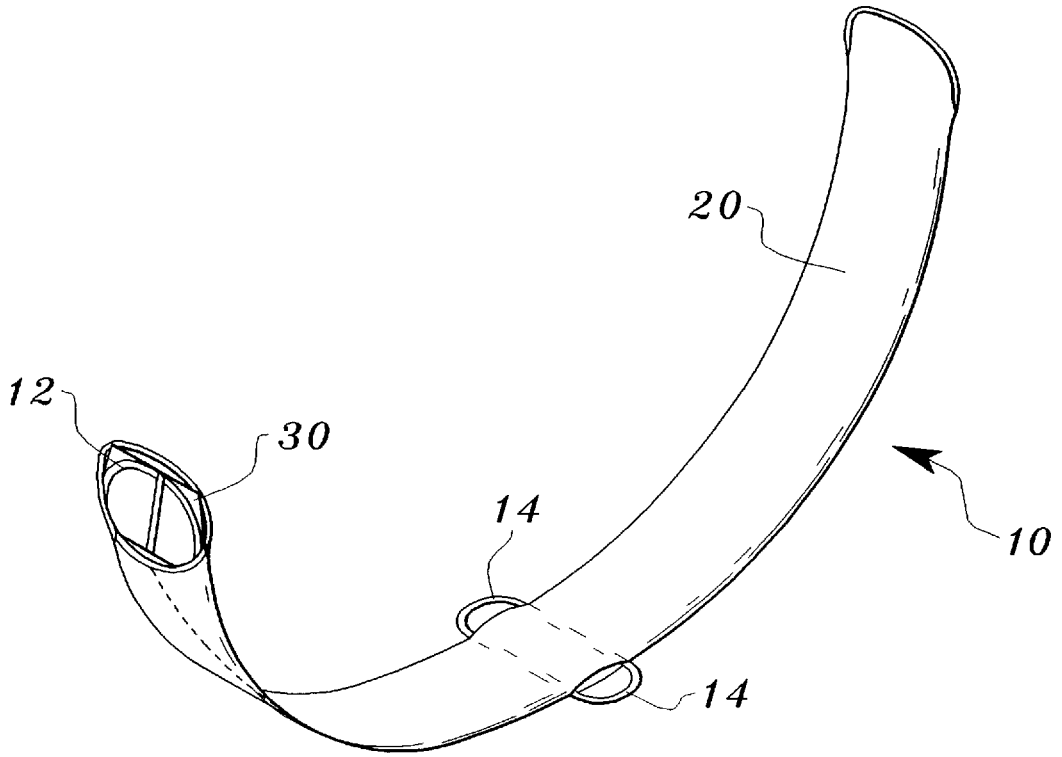
FIG. 1 is a perspective of the girth.

To aid in the correlation of the elements of the invention to the exemplary drawings, the following catalog of the elements is provided:

10 girth
12 girth buckles
14 girth rings
16 belt
20 girth cover
22 foam
26 stitching
28 inner layer
30 flap
32 textured surface

DESCRIPTION OF THE PREFERRED EMBODIMENTS

Figure 2:
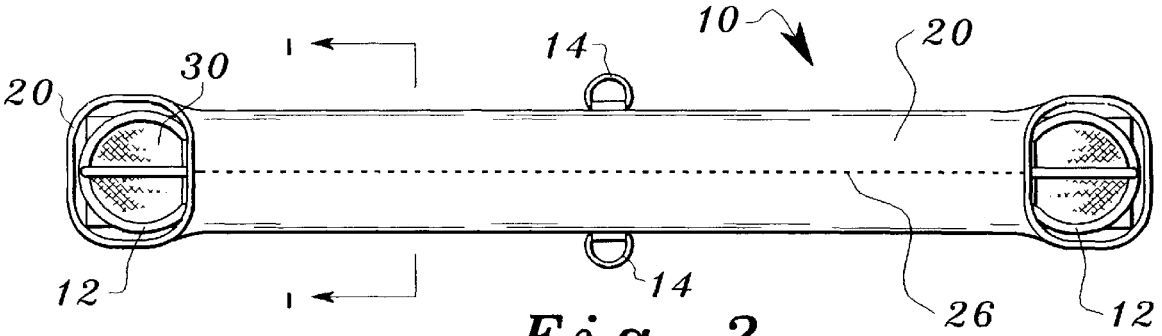
FIG. 2 is a bottom plan view of the girth with cover.

Referring to the drawings, FIG. 1 and FIG. 2 show a saddle girth 10 having a protective cover 20. The girth is a belt 16 of woven nylon or other fabric, having buckles 12 at either end for attachment to a saddle. Girth rings 14 are joined by a strap secured to the girth belt 16, and are used to attach other saddle or girth straps. A primary function of the cover 20 is to provide protective padding between the belt 16 and the horse's skin. Material for the girth cover is a closed-cell foam which does not absorb moisture.

Referring to FIG. 2, under each buckle is a protective flap 30 which provides additional protection for the horse's skin. The flap is generally made as an extension of the girth material. Protective cover 20 extends under the flap 30, i.e., extends under the side of the flap next to the horse's skin. The extension of cover 20 is sewn or otherwise bonded to the girth flap 30, so that a layer of girth material and a layer of cover material provide double padding under the buckle.

Figure 3:
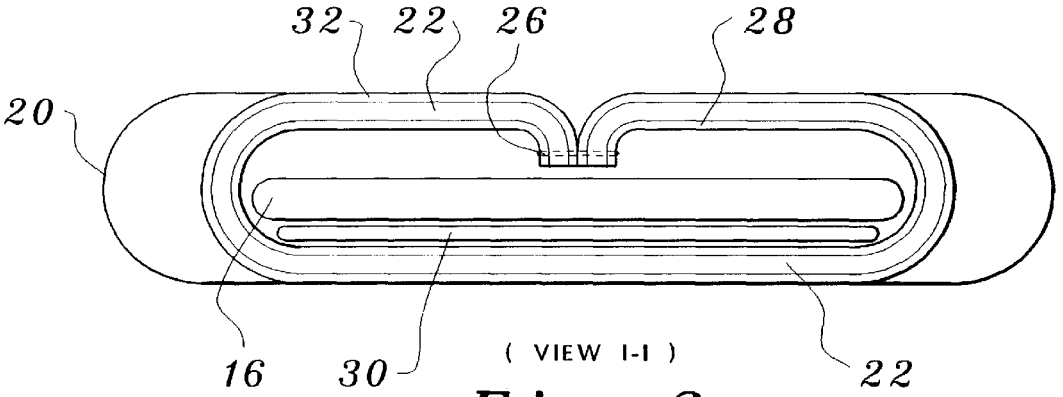
FIG. 3 is a section along view I—I of FIG. 2.
Figure 4:
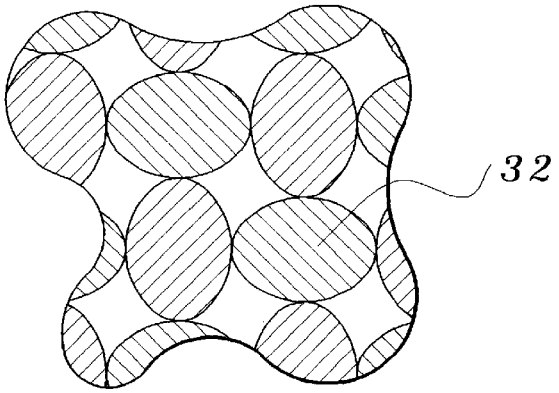
FIG. 4 is a detail showing an example of a textured surface on the girth cover.

Assembly of the protective cover is accomplished by sewing together the sides on an elongate piece of cover material to form a tube. The cover material is between ⅛" and ⅞" thick, and in the preferred embodiment is about ¼" thick. Stitching 26 is seen in FIG. 2 and FIG. 3. After the seam is trimmed, the sleeve is turned inside out to place the seam inside the tube. Each end of the sleeve is trimmed to produce the flap described above, and openings are provided on each side of the sleeve's midsection to receive the ring fasteners. A girth is inserted into the sleeve, with the seam on the side which will be next to the horse's belly. The cover is joined to the girth by a seam or other bond around the perimeter of the juxtaposed girth flaps and cover flaps.

As shown in the cross section of FIG. 3, assembly results in the belt of the girth being encased in the cover 20. The cover has a textured surface 32 which forms an outer layer of the cover. Foam layer 22, in the center of the cover, is of closed-cell foam. Adjoining the foam layer 22 is an inner layer 28 of fabric or fabric-like material; this layer is on the inner surface of the cover, adjacent the girth belt. Also shown in FIG. 3 is flap 30, extending under the buckle next to the horse's skin. On the finished product, the textured surface 32 of the cover is to the outside, enhancing the cover's appearance.

Polyvinyl chloride (PVC) is the preferred material for the protective cover; its toughness negates the need for a separate protective strip around the cover. PVC provides resistance to tearing, scratching, and abrasion, so the cover retains its effectiveness as a pad for a longer time and also keeps its appearance and cosmetic appeal. PVC is a material commonly used in the manufacture of pipes, and plastic film. In the preferred embodiment, a closed-cell foam of PVC is used for the girth cover, providing the necessary toughness and tearing resistance. Another advantage of the closed-cell foam is that it does not absorb moisture, reducing care and maintenance required to keep the girth is good condition.

As described above, all or part of the cover's outer surface is textured. At a minimum, the side or portion of the cover which contacts the horse's skin is textured; the textured surface increases the flow of air between the horse's skin and the girth cover. Additionally, the textured surface results in an increased production of lather between skin and girth, providing a natural lubricant which further reduces friction and the likelihood of galling. The texture may be incorporated into the material of the cover during the molding process, or embossed into a surface of the cover after the sleeve is fabricated.

The restrictive description and exemplary drawings of the specific examples above do not point out what an infringement of this patent would be, but are to enable one skilled in the art to make and use the invention. Various modifications can be made in the construction, material, arrangement, and operation, and still be within the scope of my invention. The limits of the invention and the bounds of the patent protection are measured by and defined in the following claims.

I claim as my invention:

1. A girth for equestrian saddles, comprising:

a belt having a first end and a second end, at least one buckle attached to said first end and at least one buckle attached to said second end, said belt having rings attached at a midsection of said belt, a protective cover for said belt including a sleeve, said sleeve being attached to said belt, said sleeve being made of a synthetic tear-resistant material, said sleeve including a raised textured surface on substantially the entire exterior surface thereof, said textured surface able to produce lather between said sleeve and a horse's skin, and said sleeve including a flap extending between said buckles and the horse's skin.

2. The invention as described in claim 1, wherein:

said tear-resistant material is a thickness of a closed-cell foam material made of polyvinyl chloride.

3. A girth for equestrian saddles having improved lubrication between said girth and a horse's skin, comprising:

a belt having a first end and a second end, at least one buckle attached to said first end and at least one buckle attached to said second end, said belt having rings attached at a midsection of said belt, a protective cover for said belt including a sleeve, said sleeve being attached to said belt, said sleeve being made of a synthetic tear-resistant material, and said sleeve including a raised textured surface on substantially the entire exterior surface thereof, said textured surface for working the horse's sweat into a lubricating lather.

4. The invention as described in claim 3, further comprising:

said tear-resistant material being a thickness of a closed-cell foam material made of polyvinyl chloride, and said tear-resistant material having a texture molded into a surface thereof.

* * * * *